US007069599B2

(12) United States Patent
Guerra

(10) Patent No.: US 7,069,599 B2
(45) **Date of Patent: *Jul. 4, 2006**

(54) COLLAPSIBLE HEADGEAR

(76) Inventor: Ricardo J. Guerra, 2017 Live Oak Dr., Weslaco, TX (US) 78596

( * ) Notice: Subject to any disclaimer, the term of this patent is extended or adjusted under 35 U.S.C. 154(b) by 0 days.

This patent is subject to a terminal disclaimer.

(21) Appl. No.: 10/470,642

(22) Filed: Oct. 15, 2004

(65) Prior Publication Data

US 2005/0229288 A1 Oct. 20, 2005

Related U.S. Application Data

(63) Continuation of application No. 10/095,787, filed on Mar. 12, 2002, now Pat. No. 6,804,831.

(51) Int. Cl.
*A42B 1/00* (2006.01)

(52) U.S. Cl. ..... 2/209.11; 2/195.5

(58) Field of Classification Search ..... 2/171.03, 2/209.13, 195.1, 195.6, 195.7, 10, 12, 209.11; 40/329

See application file for complete search history.

(56) References Cited

U.S. PATENT DOCUMENTS 281,030 A 7/1883 Cutler
360,972 A 4/1887 Prescott
893,548 A 7/1908 Rosenfeld
5,173,970 A 12/1992 Shifrin
5,367,713 A 11/1994 McCallum
5,381,559 A 1/1995 Wakefield, III
5,493,732 A 2/1996 Fawkes
5,742,944 A * 4/1998 Pfefferman ..... 2/209.12
5,832,537 A * 11/1998 Wakefield, III ..... 2/195.1
5,903,921 A * 5/1999 Dow ..... 2/12
5,991,916 A 11/1999 Sierra
6,076,192 A * 6/2000 Kronenberger ..... 2/195.6
6,804,831 B1 * 10/2004 Guerra ..... 2/209.11

* cited by examiner

*Primary Examiner*—Katherine M. Moran
(74) *Attorney, Agent, or Firm*—C. James Bushman; Browning Bushman P.C.

(57) ABSTRACT

Headgear which can be formed into a compact unit such as a carrying case comprising a headband portion and a bill portion, the bill portion being comprised of at least two bill sections which are hingedly connected to one another, the bill sections being made of a semi-rigid plastic having a shape in a relaxed position, which maintains the bill sections in an extended position, the bill sections being releasably formable into a substantially flat configuration such that when the headband is collapsed so as to be partially positionable under the bottom side of the first bill section, the collapsed headband will be at least partially disposed between the bottom side of the first bill section and the bottom side of the second bill section.

8 Claims, 2 Drawing Sheets

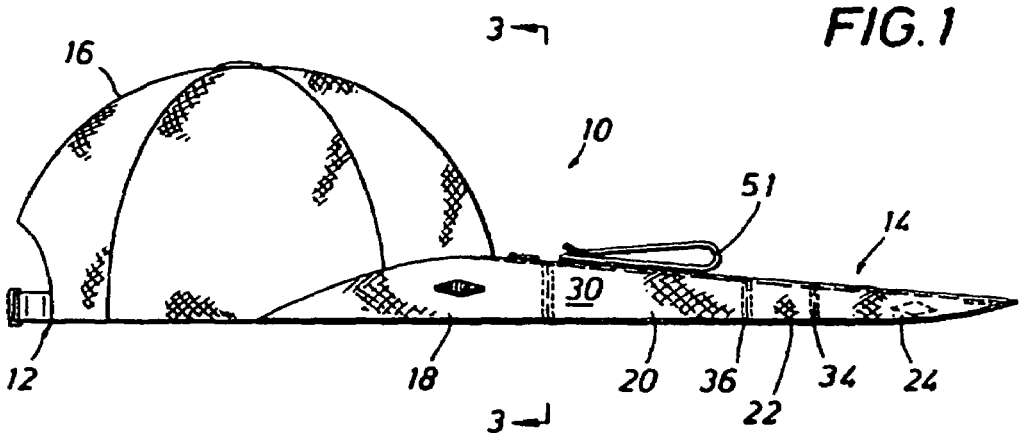
FIG. 1
FIG. 2
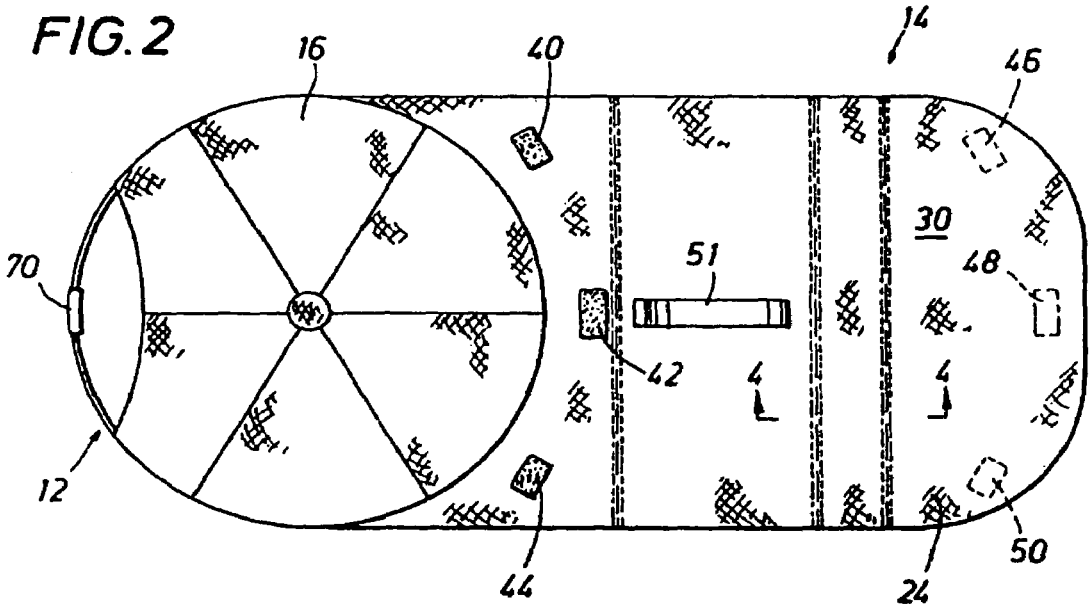
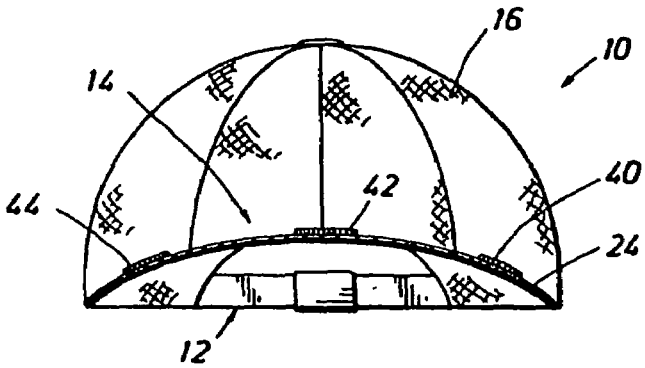
FIG. 3

COLLAPSIBLE HEADGEAR

CROSS REFERENCE TO RELATED APPLICATION

This application is a continuation of U.S. Ser. No. 10/095,787 filed on Mar. 12, 2002 now U.S. Pat. No. 6,804,831, the disclosure of which is incorporated herein by reference.

BACKGROUND OF THE INVENTION

1. Field of the Invention

The present invention relates to headgear and, more particularly, to collapsible headgear, especially to collapsible headgear having a bill of protracted length providing enhanced protection from the sun.

2. Description of the Prior Art

Spectators at outdoor sporting events and participants in other outdoor activities, such as field sports and maintenance work, could benefit from wearing headgear, such as a cap or a visor, that provides enhanced protection from the sun and other elements of weather and also that can be conveniently folded so as to form its own compact, case for transport and storage. Ideally such a cap or visor would feature a protracted bill that can be folded to form the case and, when unfolded, return the cap to its original shape and appearance. Further, the ideal cap or visor could include other features that protect the wearer from sun and weather.

Headgear such as baseball caps, visors, and the like, which can be folded or collapsed into more compact forms are known as disclosed in U.S. Pat. Nos. 2,896,218; 5,450,629; 5,845,339; and 5,903,921, to mention a few. Additionally, headgear, particularly baseball-type hats and visors with extended length or retractable bills are shown in U.S. Pat. Nos. 3,945,050; 0,075,898; 5,621,915; 5,689,830; 5,197,150 and D360,972.

SUMMARY OF THE INVENTION

The headgear of the present invention can be formed into a compact unit or case for ease of carrying and generally comprises a headband portion and a bill portion, the latter preferably being of protracted length relative to the bill of a conventional baseball cap or the like. The bill portion, in one embodiment, has at least two bill sections which are hingedly connected to one another. The bill sections are formed of a semi-rigid plastic and have a generally non-planar shape which can be considered a relaxed position wherein the bill section remains in a extended position projecting outwardly from the headband portion. The bill sections are releasably formable into a substantially flat or planar configuration whereby they can be folded around their hinged junctures. The headband is collapsible so as to be at least partially positionable under the bottom side of the first bill section. When the first and second bill sections are formed into a substantially flat configuration and the second bill section is folded to a position where the bottom side of the first and second bill sections face each other, the collapsed headband will be at least partially disposed between the bottom sides of the first and second bill sections.

BRIEF DESCRIPTION OF THE DRAWINGS

FIG. 1 is a side, elevational view of the headgear of the present invention showing the headgear in its unfolded configuration.

FIG. 2 is a top view of the headgear shown in FIG. 1.

FIG. 3 is a sectional view along the lines 3—3 of FIG. 1.

DETAILED DESCRIPTION OF PREFERRED EMBODIMENTS

Figure 4:
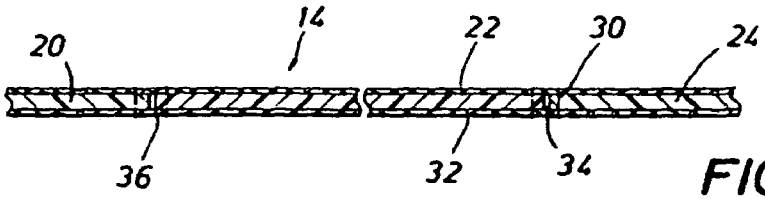
FIG. 4 is a sectional view along the lines 4—4 of FIG. 2.

With reference to FIGS. 1, 2, and 3, the present invention provides headgear, shown generally as 10, for human use and is comprised of two main portions, a headband portion shown generally as 12 and a bill portion, shown generally as 14, attached to the headband portion 12. As shown, the headgear 10 includes a crown or headcover 16 which is attached to headband 12 and a portion of bill 14. It will be understood that while the present invention is shown in the form of a cap similar to a baseball cap, it can be made into many forms, e.g., visors, and can include flaps which drape down over the ears and the neck to prevent those areas of the body from excessive exposure to the elements.

Figure 5:
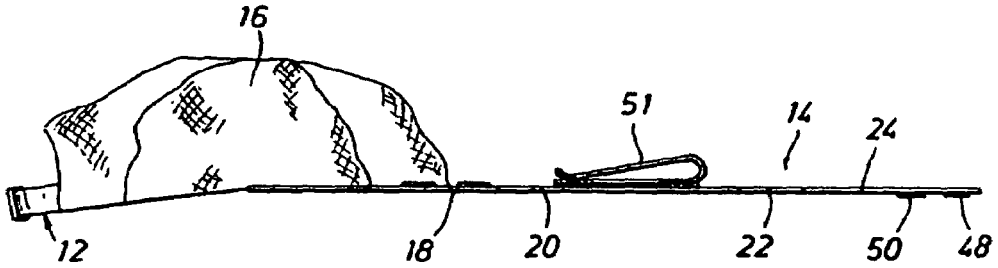
FIG. 5. is a side, elevational view of the headgear of the present invention showing the bill in a flattened configuration prior to folding.

As best seen with reference to FIGS. 1, 2 and 4, bill portion 14 is made up of a series of bill sections, a first bill section 18 being attached to headband 12, a second bill section 20 being hingedly attached to first bill section 18, a third bill section 22 being hingedly attached to second bill section 20 and a fourth bill section 24 being hingedly attached to third bill section 22, bill section 24 forming the outer most end of the bill 14 distal headband 12. As best seen with reference to FIG. 4, the sections making up bill portion 14 are made of a semi-rigid plastic such as various types of polyethylene, polypropylene or numerous other polymeric materials. The polymeric material making up the sections of the bill portion 14 is semi-rigid in the sense that it can be initially formed in a desired first configuration, and formed into a second, different configuration under the exertion of a force. The plastic material is of a nature such that when the force is removed it possesses sufficient memory to return to its first configuration. The first or original formed configuration can be considered the relaxed condition of the bill sections, i.e., it is the configuration that the bill sections will naturally assume until sufficient force is exerted to force the sections to another configuration, i.e., substantially flat. Thus, as best seen with reference to FIG. 3, the sections 18, 20, 22 and 24 of bill portion 14 are generally formed with an arched shape but, as best seen with reference to FIG. 5, can be formed into a substantially flat configuration. However, when the force acting to form bill portion 14 into a substantially flat configuration as shown in FIG. 5 is released, because of the memory possessed by the polymeric material from which the bill sections are made, the bill sections will return to the arched configuration shown in FIGS. 1 and 3. It will be recognized that the arched shape of the bill sections making up bill 14 act to maintain each of the bill sections in the configuration shown in FIG. 1 and ensure that the bill 14 remains extended. In effect, the arched shape acts to provide what can be likened to resilient stiffening ribs or members which maintain the bill in its extended position as shown in FIG. 1. The term "arched shape" as used herein is intended to include not only the generally arcuate shape which is depicted in the drawing but also a configuration wherein each side or edge of the bill sections could be provided with a downwardly depending flange portion which together with the remaining portion of the bill section could still be formed into a substantially flat configuration to allow the folding of the bill section as described above. It will be appreciated that these flange portions would act as stiffening ribs as noted above. Obviously, other shapes of the bill portion 14 could be employed provided that the bill portion 14 could be moved from a first configuration wherein the bill sections are maintained in an extended position projecting outwardly from the headband to a second position wherein the bill sections can be formed into a substantially flat configuration to allow folding of the headgear.

As noted, the bill sections are hingedly secured to one another, and to this end, bill portion 14 is provided with a first fabric layer 30 which overlays the top side of the bill sections and a second fabric layer 32 which overlays the bottom sides of the bill sections. Additionally, and as seen in FIG. 4, the first and second layers of fabric, 30 and 32 respectively, are secured to one another as by stitching at the hinged junctures between the hinged sections of bill 14. Thus, for example, at the juncture between bill sections 22 and 24, first and second layers 30 and 32 of the fabric are secured to one another as by stitching as indicated at 34. In like fashion, at the hinged juncture between bill sections 22 and 20, the first and second layers of fabric 30, 32 respectively, are secured to one another as by stitching as indicated at 36. It will be appreciated that the bill sections can be hingedly secured to one another by other techniques, use of the first and second fabric layers 30 and 32 in the manner described above being only one of such methods.

As best seen in FIGS. 1, 2 and 5, the top side bill section 18 of bill 14 is provided with a series of fasteners 40, 42 which are generally spaced over the width of the bill 14 and are either of the hook or loop type. Cooperating with these fasteners in a manner described hereafter are complementary hook or loop fasteners 46, 48 and 50 which are secured to the bottom side of bill section 24 of bill portion 14. Secured to the top side of bill portion 14 and attached to second bill section 20 is a spring clip 50 which allows headgear 10 to be secured to a belt or the like when in its compact form as shown hereafter. It will be appreciated that other types of fasteners such as snaps and the like can also be employed.

Figure 6:
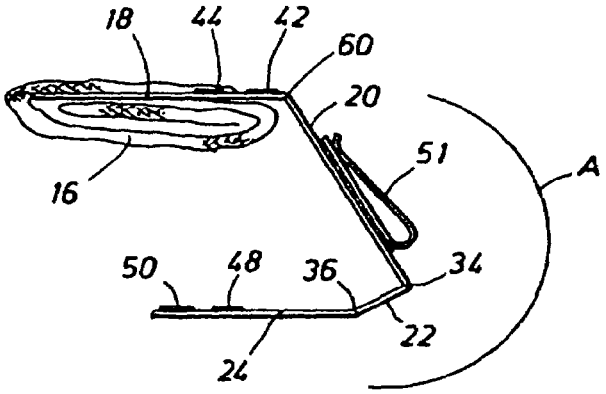
FIG. 6 is a side, elevational view of the headgear of the present invention showing the headgear in a partially folded configuration.
Figure 7:
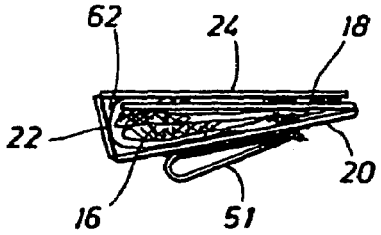
FIG. 7 is side, elevational view of the headgear of the present invention showing the headgear in its fully folded configuration.

Reference is now made to FIGS. 5–7 for a description of how the headgear 10 of the present invention can be formed into a compact unit which can be easily carried or stored.

Referring first to FIG. 5, it can be seen that the bill sections 20–24 have been formed into the substantially flat condition, i.e., they have been moved out of the arcuate position shown in FIG. 1. In this configuration, the individual bill sections can be folded to achieve the compact unit desired. To this end, and as shown in FIG. 6, headband 12 including the crown 16 would be folded or collapsed so that at least a portion of it was adjacent the bottom side of first bill section 18. The second bill section 20 could then be folded in the direction of arrow A in FIG. 6 along the hinge connector 60. Likewise, bill sections 22 and 24 could be folded along hinge connections 34 and 36. As best seen with reference to FIG. 7, when the bill sections 20–24 have been folded, there is a pocket 62 formed by bill sections 24, 22 and 20, the pocket 62 receiving the collapsed headband 12 and crown 16 and first bill portion 18. To maintain the headgear in its collapsed or compact position, the hook/loop fasteners 46, 48 and 50 are engaged with the corresponding hook/loop fasteners 40, 42 and 44, respectively. The headgear 10 has now been formed into a compact unit or carrying case which can be readily fastened to a belt or the like using the spring clip 50.

A particular feature of the present invention as shown in the drawings is the fact that the bill portion 14 is of a protracted length, i.e., it extends outwardly from the headband 12 a greater length than is conventional in baseball caps, visors and the like. This provides enhanced protection from the sun and finds particular application if the wearer is positioned watching an event such as a football game wherein the bill portion 14 is pointing toward the sun. On the other hand, it will be appreciated that bill sections 22 and 24 could be dispensed with if it was merely desired to make a collapsible or foldable headgear and, in this regard, a portion of the crown 16 could have properly positioned hook or loop fasteners which would mate with properly positioned hook or loop fasteners on the bottom side of second bill section 20 such that when second bill section 20 was folded such that the bottom side of bill section 20 substantially faced the bottom side of bill section 18, the hook and loop fasteners on crown 16 at some other portion of headband 12 would engage the corresponding fasteners on bill section 20. Obviously, other types of fasteners could be employed. Further, instead of the fastener, a tie could be wrapped around the two folded sections. Although such a configuration would not provide as neat a carrying case as depicted in FIG. 7, it would still serve to provide headgear that was foldable into a compact shape for carrying in a pocket, luggage or the like.

As is well known with respect to headgear such as baseball caps, visors and the like, the headband 12 can be provided with a size adjusting mechanism indicated at 70. Such adjustments include belts and buckles, hook and loop fasteners, etc. employed.

The foregoing description and examples illustrate selected embodiments of the present invention. In light thereof, variations and modifications will be suggested to one skilled in the art, all of which are in the spirit and purview of this invention.

The invention claimed is:

1. Headgear which can be formed into a compact unit for ease of carrying comprising:

a headband portion; and a bill portion, said bill portion being comprised of a first bill section having a top side, a bottom side and being attached to said headband, a second bill section having a top side, a bottom side and being hingedly connected to said first bill section, a third bill section having a top side and a bottom side and being hingedly connected to said second bill section, and a fourth bill section having a top side and a bottom side and being hingedly connected to said third bill section, said headband being collapsible so as to be at least partially positionable under said bottom side of said first bill section, said collapsed headband being at least partially disposed between said bottom side of said first bill section and said bottom side of said second bill section when said second bill section is folded to a position wherein said bottom side of said first and second bill sections face each other, said third and fourth bill sections being foldable whereby said bottom side of said fourth section substantially faces said top side of said first bill section, said third section cooperating with said second and fourth sections to form a pocket for said collapsed headband and said first bill section.

2. The headgear of claim 1 further including a head cover attached to said headband.

3. The headgear of claim 2 wherein said head cover is collapsible.

4. The headgear of claim 1 wherein top side of said first section and the bottom side of said fourth section have mating releasably engageable fasteners.

5. The headgear of claim 4 wherein said fasteners comprise hook and loop fasteners.

6. The headgear of claim 1 wherein there is a clip attached to the top side of said second section for attaching said headgear when in a compact unit to a belt or the like.

7. The headgear of claim 1 wherein said headband is adjustable.

8. The headgear of claim 1 wherein there is a first fabric layer covering the top side of said bill sections and a second fabric layer covering the bottom side of said bill sections, said first and second fabric layers being interconnected at the hinged junctions of said bill sections to form hinges between said hinged sections.

* * * * *